US006817331B2

(12) United States Patent
Takada et al.

(10) Patent No.: US 6,817,331 B2
(45) Date of Patent: Nov. 16, 2004

(54) INTERNAL COMBUSTION ENGINE PROVIDED WITH DECOMPRESSING MECHANISMS

(75) Inventors: Hideaki Takada, Saitama (JP); Nobuo Suzuki, Saitama (JP); Hiroyuki Yoshida, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/407,003

(22) Filed: Apr. 4, 2003

(65) Prior Publication Data

US 2003/0188707 A1 Oct. 9, 2003

(30) Foreign Application Priority Data

Apr. 8, 2002 (JP) ..... 2002-105701

(51) Int. Cl.[7] ..... F01L 13/08
(52) U.S. Cl. ..... 123/182.1
(58) Field of Search ..... 123/182.1

(56) References Cited

U.S. PATENT DOCUMENTS 5,687,683 A * 11/1997 Knoblauch ..... 123/182.1
2002/0078915 A1 * 6/2002 Schneider et al. ..... 123/182.1
2003/0145819 A1 * 8/2003 Yoshida et al. ..... 123/182.1

FOREIGN PATENT DOCUMENTS

JP 20014-221023 8/2001

* cited by examiner

*Primary Examiner*—Andrew M. Dolinar
(74) *Attorney, Agent, or Firm*—Carrier, Blackman & Associates, P.C.; Joseph P. Carrier; William D. Blackman

(57) ABSTRACT

An internal combustion engine is provided with a decompressing mechanism including: a pin supported so as to be turnable on a camshaft; a flyweight supported for turning relative to the camshaft by the pin on the camshaft; and a decompression cam capable of operating together with the flyweight to apply valve opening force to an engine valve. The pin is inserted in holes formed in the flyweight so as to be turnable. A spring washer restrains the pin and the flyweight from movement relative to each other, so that generation of rattling noise due to collision between the pin and the flyweight can be prevented or controlled.

6 Claims, 12 Drawing Sheets

INTERNAL COMBUSTION ENGINE PROVIDED WITH DECOMPRESSING MECHANISMS

BACKGROUND OF THE INVENTION

1. Field of the Invention

The present invention relates to an internal combustion engine provided with centrifugal decompressing mechanisms for reducing compression pressure to facilitate starting the internal combustion engine by opening a valve included in the internal combustion engine during the compression stroke in starting the internal combustion engine.

2. Description of the Related Art

An internal combustion engine provided with centrifugal decompressing mechanisms each including a flyweight is disclosed in JP2001-221023A. A decompression lever included in this prior art decompressing mechanism is integrally provided with a flyweight and a decompression cam. There is formed a round hole of a diameter slightly greater than that of a pin fixedly pressed in a camshaft in a position perpendicular to the axis of the camshaft. The decompression lever is supported by the pin inserted in the round hole for turning on the camshaft.

Assembling the decompression lever provided with the flyweight of the prior art decompressing mechanism and the camshaft requires troublesome work for pressing the pin in the hole formed in the camshaft. Assembling facility may be improved by fitting the pin in the hole of the camshaft in a running fit.

Since the pin inserted in the hole of the flyweight supports the flyweight for turning thereon, there is a small clearance between the pin and the flyweight and, if the pin is inserted in the hole of the camshaft in a running fit, there is also a small clearance between the pin and the camshaft. Consequently, the flyweight and the pin are liable to move relative to each other in directions parallel to the axis of turning of the flyweight and in directions of turning of the flyweight, and the flyweight located at a decompression withholding position is caused to move relative to and strike against the pin by the vibrations of the internal combustion engine, which is liable to generate rattling noise.

The present invention has been made in view of the foregoing problems and it is therefore an object of the present invention to restrain the flyweight of a decompressing mechanism from movement relative to a pin supporting the flyweight for turning thereon, and to prevent or control the generation of rattling noise. Another object of the present invention is to reduce the clearance between the pin and the flyweight to substantially null to prevent or control the generation of rattling noise.

SUMMARY OF THE INVENTION

According to the present invention, an internal combustion engine comprises: a crankshaft; a camshaft driven for rotation in synchronism with the crankshaft; an engine valve controlled for opening and closing by a valve-operating cam; and a decompressing mechanism for opening the engine valve during a compression stroke in a starting phase; wherein the decompressing mechanism (D) includes: a pin supported so as to be turnable on the camshaft; a flyweight supported for turning relative to the camshaft by the pin on the camshaft; and a decompression cam capable of operating together with the flyweight to apply valve opening force to the engine valve; the pin is inserted in holes formed in the flyweight so as to be turnable; and a restraint is provided to restrain the pin and the flyweight from movement relative to each other.

In this internal combustion engine, facility of mounting the flyweight on the camshaft is improved because the pin is able to turn relative to the camshaft, and the collision of the flyweight and the pin against each other due to vibrations of the internal combustion engine is prevented or controlled because the flyweight and the pin are restrained from movement relative to each other.

Thus, the present invention has the following effects. Since the pin supporting the flyweight of the decompressing mechanism is supported so as to be turnable on the camshaft, facility of mounting the flyweight on the camshaft is improved. Since the pin and the flyweight are interlocked by the restraining means capable of restraining the pin and the flyweight from movement relative to each other, generation of rattling noise due to the collision of the pin and the flyweight against each other due to the vibrations of the internal combustion engine can be prevented or controlled.

The restraint may restrain the pin and the flyweight from movement relative to each other in directions parallel to the axis of turning of the flyweight swings.

The restraint which restrains the pin and the flyweight from movement relative to each other in directions parallel to the axis of turning of the flyweight may include an elastic member placed between the pin and the flyweight and capable of applying resilient force to the pin and the flyweight.

Frictional forces due to the resilient force of the elastic member acting between the elastic member and the pin, between the elastic member and the flyweight and between the flyweight and the pin, restrain the flyweight and the pin from movement and turning relative to each other.

The restraint which restrains the pin and the flyweight from movement relative to each other in directions parallel to the axis of turning of the flyweight may include a first connecting part formed in one of the pin and the flyweight; and a second connecting part formed in the other of the flyweight and the pin for engaging with the first connecting part, the first connecting part has a first taper part, and the second connecting part has a second taper part formed in a shape conforming to that of the first taper part through plastic deformation of a part of one of the flyweight and the pin after the pin has been inserted in the holes.

Since the second taper part is formed through copying plastic deformation so as to conform to the first taper part after the pin has been inserted in the holes and the flyweight has been temporarily mounted on the pin, the deviation of the degree of plastic deformation can be easily absorbed by the taper parts of the connecting parts. Thus, the gap between the pin and the flyweight with respect to directions parallel to the axis of turning can be diminished substantially to null by a simple method that processes the flyweight or the pin for plastic deformation and the pin and the flyweight are restrained accurately from movement relative to each other in directions parallel to the axis of turning.

The restraint may restrain the pin and the flyweight from movement relative to each other in turning directions of turning of the flyweight. Thus, the pin and the flyweight are restrained from movement relative to each other in the turning directions.

The restraint which restrains the pin and the flyweight from movement relative to each other in the turning directions may include a first connecting part formed in one of the pin and the flyweight and a second connecting part formed in the other of the flyweight and the pin for engaging with the first connecting part, and the first and the second connecting parts may be provided with first and second detaining parts, respectively. The restraint including the first and the second connecting parts provided with the detaining parts restrains the pin and the flyweight from movement relative to each other in the turning directions. The first and the second detaining parts of the restraint which restrains the pin and the flyweight from movement relative to each other in the turning directions may have non-circular shapes, respectively, as viewed along the axis of turning of the flyweight.

In the restraint which restrains the pin and the flyweight from movement relative to each other in the turning directions, the first connecting part may have a first taper part and a first detaining part, and the second connecting part may have a second taper part and a second detaining part formed through the plastic deformation of a part of one of the flyweight and the pin so that the second taper part and the second detaining part conform to the first taper part and the first detaining part, respectively, after inserting the pin in the holes.

Thus, the deviation of the degree of plastic deformation can be easily absorbed by the taper parts of the connecting parts. Therefore, the gap between the pin and the flyweight with respect to directions parallel to the axis of turning and the gap between the pin and the flyweight with respect to the turning directions of the flyweight can be diminished substantially to null.

Consequently, the deviation of the degree of plastic deformation can be easily absorbed by the taper parts of the connecting parts. The gap between the pin and the flyweight with respect to directions parallel to the axis of turning can be diminished substantially to null by a simple method that processes the flyweight or the pin for plastic deformation and the pin and the flyweight are restrained accurately from movement relative to each other in directions parallel to the axis of turning and the turning directions.

The internal combustion engine may be provided with both the restraint which restrains the pin and the flyweight from movement relative to each other in directions parallel to the turning axis of the flyweight and the restraint which restrains the pin and the flyweight from movement relative to each other in the turning directions. Thus, the pin and the flyweight can be surely restrained from movement relative to each other.

DESCRIPTION OF THE PREFERRED EMBODIMENTS

An internal combustion engine provided with decompressing mechanisms in a preferred embodiment of the present invention will be described with reference to FIGS. 1 to 9.

Figure 1:
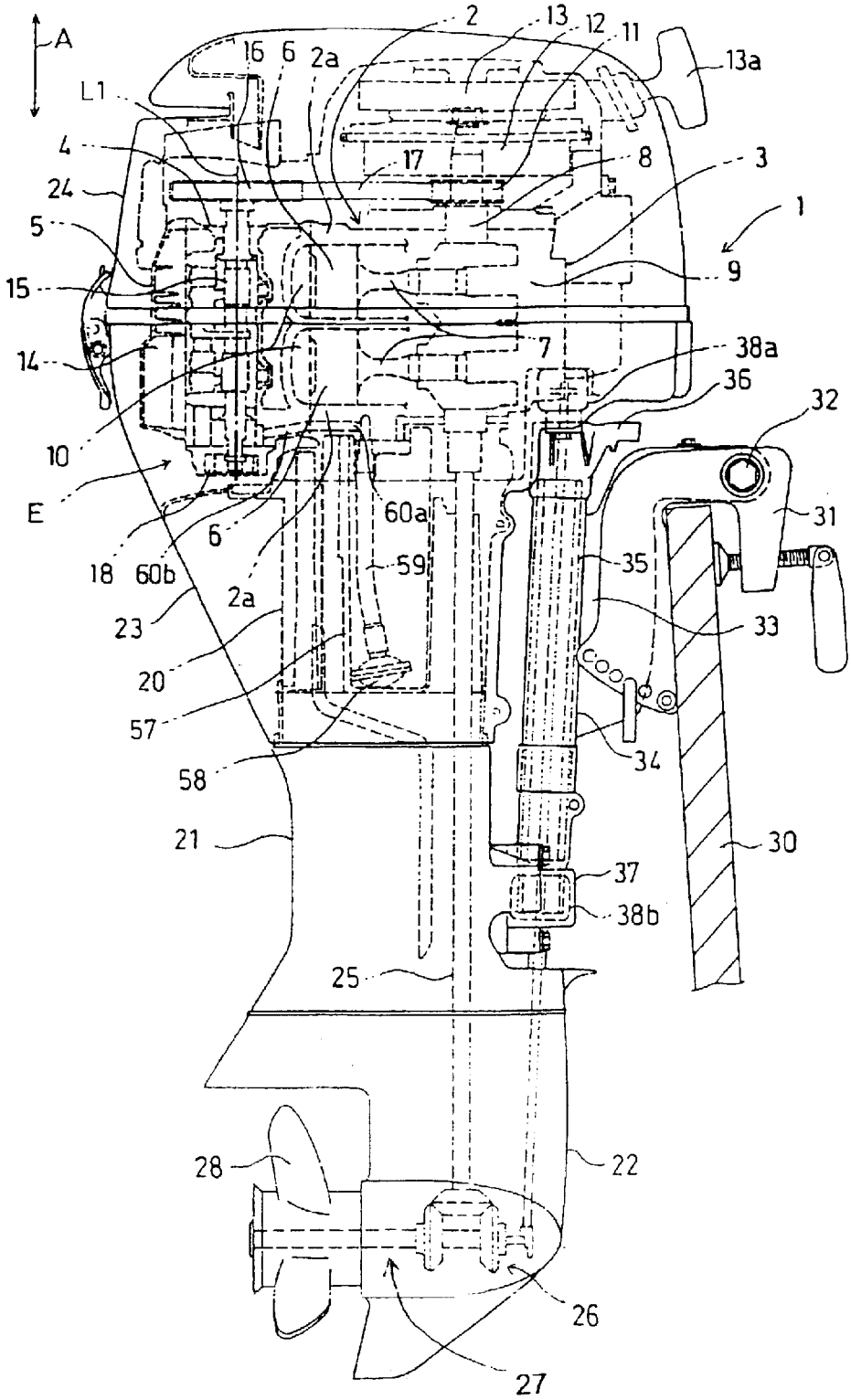
FIG. 1 is a schematic side elevation of an outboard motor including an internal combustion engine provided with decompressing mechanisms in a preferred embodiment according to the present invention.

FIGS. 1 to 7 are views of assistance in explaining the first embodiment. Referring to FIG. 1, an internal combustion engine E provided with decompressing mechanisms D according to the present invention is a water-cooled, inline, two-cylinder, four-stroke-cycle, vertical internal combustion engine installed in an outboard motor with the axis of rotation of its crankshaft 8 vertically extended. The internal combustion engine E comprises a cylinder block 2 provided with two cylinder bores 2*a* in a vertical, parallel arrangement with their axes longitudinally horizontally extended, a crankcase 3 joined to the front end of the cylinder block 2; a cylinder head 4 joined to the rear end of the cylinder block 2; and a cylinder head covers joined to the rear end of the cylinder head 4. The cylinder block 2, the crankcase 3, the cylinder head 4 and the cylinder head cover 5 constitute an engine body.

A piston 6 is fitted for reciprocating sliding motions in each of the cylinder bores 2*a* and is connected to a crankshaft 8 by a connecting rod 7. The crankshaft 8 is installed in a crank chamber 9 and is supported for rotation in upper and lower plain bearings on the cylinder block 2 and the crankcase 3. The crankshaft 8 is driven for rotation by the pistons 6 driven by combustion pressure produced by the combustion of an air-fuel mixture ignited by spark plugs. The phase difference between the pistons 6 fitted in the two cylinder bores 2*a* corresponds to a crank angle of 360°. Therefore, combustion occurs alternately in the cylinder bores 2*a* at equal angular intervals in this internal combustion engine E. A crankshaft pulley 11 and a rewind starter 13 are mounted in that order on an upper end part of the crankshaft 8 projecting upward from the crank chamber 9.

Figure 2:
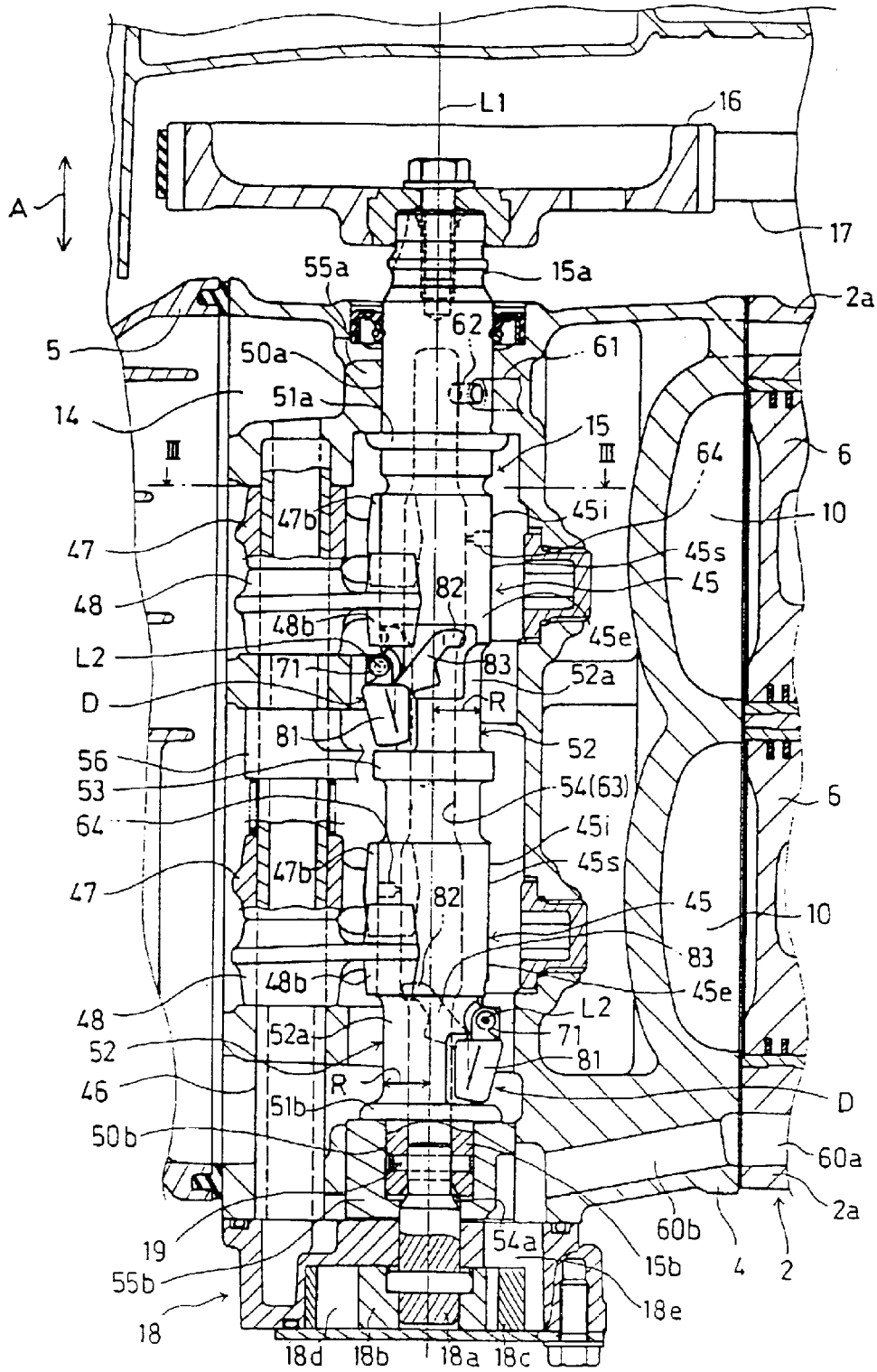
FIG. 2 is a longitudinal sectional view of a cylinder head and associated parts included in the internal combustion engine shown in FIG. 1.

Referring to FIGS. 1 and 2, a camshaft 15 is installed in a valve gear chamber 14 defined by the cylinder head 4 and the cylinder head cover 5 and is supported for rotation on the cylinder head 4 with its axis L1 of rotation extended in parallel with that of the crankshaft 8. A camshaft pulley 16 is mounted on an upper end part 15*a* of the camshaft 15 projecting upward from the valve gear chamber 14. The camshaft 15 is driven for rotation in synchronism with the crankshaft 8 at a rotating speed equal to half that of the crankshaft 8 by the crankshaft 8 through a transmission mechanism including the crankshaft pulley 11, the camshaft pulley 16 and a timing belt 17 extended between the pulleys 11 and 16. A lower end part 15*b* of the camshaft 15 is coupled by a shaft coupling 19 with a pump drive shaft 18*a* connected to the inner rotor 18*b* of a trochoid oil pump 18 attached to the lower end wall of the cylinder head 4.

As shown in FIG. 1, the engine body is joined to the upper end of a support block 20. An extension case 21 has an upper end joined to the lower end of the support block 20 and a lower end joined to a gear case 22. An under cover 23 joined to the upper end of the extension case 21 covers a lower half part of the engine body and the support block 20. An engine cover 24 joined to the upper end of the under cover 23 covers an upper half part of the engine body.

A drive shaft 25 connected to a lower end part of the crankshaft 8 extends downward through the support block 20 and the extension case 21, and is connected to a propeller shaft 27 by a propelling direction switching device 26 including a bevel gear mechanism and a clutch mechanism. The power of the internal combustion engine E is transmitted through the crankshaft 8, the drive shaft 25, a propelling direction switching device 26 and the propeller shaft 27 to a propeller 28 fixedly mounted on a rear end part of the propeller shaft 27 to drive the propeller 28 for rotation.

The outboard motor 1 is detachably connected to a hull 30 by a transom clamp 31. A swing arm 33 is supported for swing motions in a vertical plane by a tilt shaft 32 on the transom clamp 31. A tubular swivel case 34 is connected to the rear end of the swing arm 33. A swivel shaft 35 fitted for rotation in the swivel case 34 has an upper end part provided with a mounting frame 36 and a lower end part provided with a center housing 37. The mounting frame 36 is connected elastically through a rubber mount 38*a* to the support block 20. The center housing 37 is connected elastically through a rubber mount 38*b* to the extension case 21. A steering arm, not shown, is connected to the front end of the mounting frame 36. The steering arm is turned in a horizontal plane for controlling the direction of the outboard motor 1.

Further description of the internal combustion engine E will be made with reference to FIGS. 2 and 3. An intake port 40 through which an air-fuel mixture prepared by a carburetor, not shown, flows into a combustion chamber 10 and an exhaust port 41 through which combustion gases discharged from the combustion chamber 10 flows are formed for each of the cylinder bores 2*a* in the cylinder head 4. An intake valve 42 that opens and closes the intake port 40 and an exhaust valve 43 that opens and closes the exhaust port 41 are urged always in a closing direction by the resilience of valve springs 44. The intake valve 42 and the exhaust valve 43 are operated for opening and closing operations by a valve train installed in the valve gear chamber 14. The valve train includes the camshaft 15, valve-operating cams 45 formed on the camshaft 15 so as to correspond to the cylinder bores 2*a*, intake rocker arms (cam followers) 47 mounted for rocking motion on a rocker shaft 46 fixedly supported on the cylinder head 4 and driven by the valve-operating cams 45, and exhaust rocker arms (cam followers) 48 mounted on the rocker shaft 46 and driven by the valve-operating cams 45.

Each valve-operating cam 45 has an intake cam part 45*i*, an exhaust cam part 45*e*, and a cam surface 45*s* common to the intake cam part 45*i* and the exhaust cam part 45*e*. The intake rocker arm 47 has one end part provided with an adjusting screw 47*a* in contact with the intake valve 42 and the other end provided with a slipper 47*b* in contact with the cam surface 45*s* of the intake cam part 45*i* of the valve-operating cam 45. The exhaust rocker arm 48 has one end provided with an adjusting screw 48*a* in contact with the exhaust valve 43 and the other end provided with a slipper 48*b* in contact with the cam surface 45*s* of the exhaust cam part 45*e* of the valve-operating cam 45. The cam surface 45*s* of the valve-operating cam 45 has a heel 45*a* of a shape conforming to a base circle for keeping the intake valve 42 (exhaust valve 43) closed, and a toe 45*b* that times the operation of the intake valve 42 (exhaust valve 43) and determines the lift of the intake valve 42 (exhaust valve 43). The valve-operating cams 45 rotate together with the camshaft 15 to rock the intake rocker arms 47 and the exhaust rocker arms 48 to operate the intake valves 42 and the exhaust valves 43.

As shown in FIG. 2, the camshaft 15 has the pair of valve-operating cams 45, an upper journal 50*a*, a lower journal 50*b*, an upper thrust-bearing part 51*a* continuous with the upper journal 50*a*, a lower thrust-bearing part 51*b* continuous with the lower journal 50*b*, shaft parts 52 extending between the valve-operating cams 45 and between the valve-operating cam 45 and the lower thrust-bearing part 51*b*, and a pump-driving cam 53 for driving a fuel pump, not shown. The camshaft 15 has a central bore 54 having an open lower end opening in the end surface of the lower end part 15*b* in which the lower journal 50*b* is formed, and a closed upper end in the upper journal 50*a*. The bore 54 extends vertically in the direction of the arrow A parallel with the axis of rotation of the camshaft 15.

The upper journal 50*a* is supported for rotation in an upper bearing 55*a* held in the upper wall of the cylinder head 4, and a lower journal 55*b* is supported for rotation in a lower bearing 55*b* held in the lower wall of the cylinder head 4. Each shaft part 52 has a cylindrical surface 52*a* having the shape of a circular cylinder of a radius R smaller than the radius of the heel 45*a* of a shape conforming to the base circle. The pump-driving cam 53 is formed on the shaft part 52. The pump-driving cam 53 drives a drive arm 56 supported for swinging on the rocker shaft 46 for swing motion to reciprocate the drive rod included in the fuel pump in contact with the drive arm 56.

A lubricating system will be described. Referring to FIG. 1, an oil pan 57 is formed in the support block 20. A lower end provided with an oil strainer 58 of a suction pipe 59 is immersed in lubricating oil contained in the oil pan 57. The suction pipe 59 has an upper end connected by a joint to an oil passage 60*a* formed in the cylinder block 2. The oil passage 60*a* communicates with the suction port 18*e* (FIG. 2) of the oil pump 18 by means of an oil passage 60*b* formed in the cylinder head 4.

The discharge port, not shown, of the oil pump 18 is connected through oil passages, not shown, formed in the cylinder head 4 and the cylinder block 2, and an oil filter, not shown, to a main oil passage, not shown, formed in the cylinder block 2. A plurality of branch oil passages branch from the main oil passage. The branch oil passages are connected to the bearings and sliding parts including the plain bearings supporting the crankshaft 8 of the internal combustion engine E. One branch oil passage 61 among the plurality of branch oil passages is formed in the cylinder head 4 to supply the lubricating oil to the sliding parts of the valve train and the decompressing mechanisms D in the valve gear chamber 14 as shown in FIG. 2.

The oil pump 18 sucks the lubricating oil into a pump chamber 81*d* formed between an inner rotor 18*b* and an outer rotor 18*c* through the oil strainer 58, the suction pipe 59, the oil passages 60*a* and 60*b* from the oil pan 57. The high-pressure lubricating oil discharged from the pump chamber 18*d* flows through the discharge port, the oil filter, the main oil passage and the plurality of branch passages including the branch passage 61 to the sliding parts.

Part of the lubricating oil flowing through the oil passage 61 opening into the bearing surface of the upper bearing 55*a* flows through an oil passage 62 formed in the upper journal 50*a* and opening into the bore 54. The oil passage 62 communicates intermittently with the oil passage 61 once every one turn of the camshaft 15 to supply the lubricating oil into the bore 54. The bore 54 serves as an oil passage 63. The lubricating oil supplied into the oil passage 63 flows through oil passages 64 opening in the cam surfaces 45*s* of the valve-operating cams 45 to lubricate the sliding surfaces of the slippers 47*a* of the intake rocker arms 47 and the valve-operating cams 45 and to lubricate the sliding surfaces of the slippers 48*b* of the exhaust rocker arms 48 and the valve-operating cams 45. The rest of the lubricating oil flowing through the oil passage 63 flows out of the oil passage 63 through an opening 54*a* to lubricate the sliding parts of the lower bearing 55*b* and the lower journal 50*b*, and the sliding parts of the lower Thrust-bearing part 51*b* and the lower bearing 55*b*, and flows into the valve gear chamber 14. The oil passages 64 do not need to be formed necessarily in parts shown in FIG. 2; the oil passages 64 may be formed, for example, in parts opposite to the toes 45*b* of the valve-operating cams 45 across the axis L1 of rotation.

The rest of the lubricating oil flowing through the oil passage 61 flows through a small gap between the upper journal 50*a* and the upper bearing 55*a* to lubricate the sliding parts of the Thrust-bearing part 51*a* and the upper bearing 55*a*, and flows into the valve gear chamber 14. The lubricating oil flowed through the oil passages 61 and 64 into the valve gear chamber 14 lubricates the sliding parts of the intake rocker arms 47, the exhaust rocker arms 48, the drive arm, and the rocker shaft 46. Eventually, the lubricating oil flowing through the oil passage 61 drops or flows down to the bottom of the valve gear chamber 14, and flows through return passages, not shown, formed in the cylinder head 4 and the cylinder block 2 to the oil pan 57.

Figure 3:
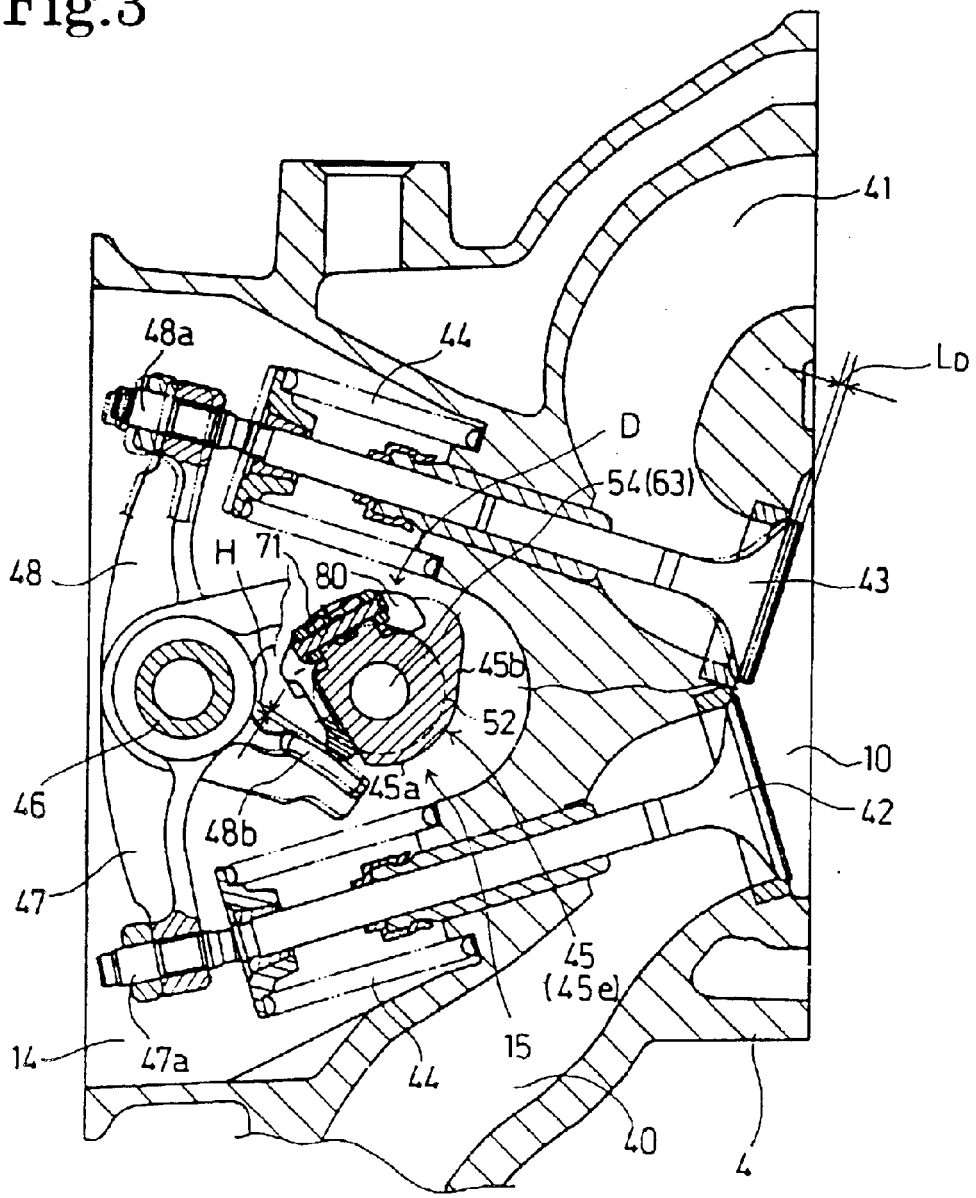
FIG. 3 is a view including a sectional view taken on line III—III in FIG. 2, a sectional view in a plane including the axes of an intake valve and an exhaust valve, and a sectional view of a camshaft similar to FIG. 4.

As shown in FIGS. 2 and 3, the decompressing mechanisms D are combined with the camshaft 15 so as to correspond to the cylinder bores 2*a*, respectively. The decompressing mechanisms D perform a decompressing operation to reduce force necessary for operating the rewind starter 13 in starting the internal combustion engine E. Each decompressing mechanism D lets the corresponding cylinder bore 2*a* discharges the gas contained therein in a compression stroke through the exhaust port 41 to decompress the cylinder bore 2*a*. The decompressing mechanisms D are identical and the difference in phase between the decompressing mechanisms D is equal to a cam angle of 180° corresponding to a crank angle of 360°.

Figure 4:
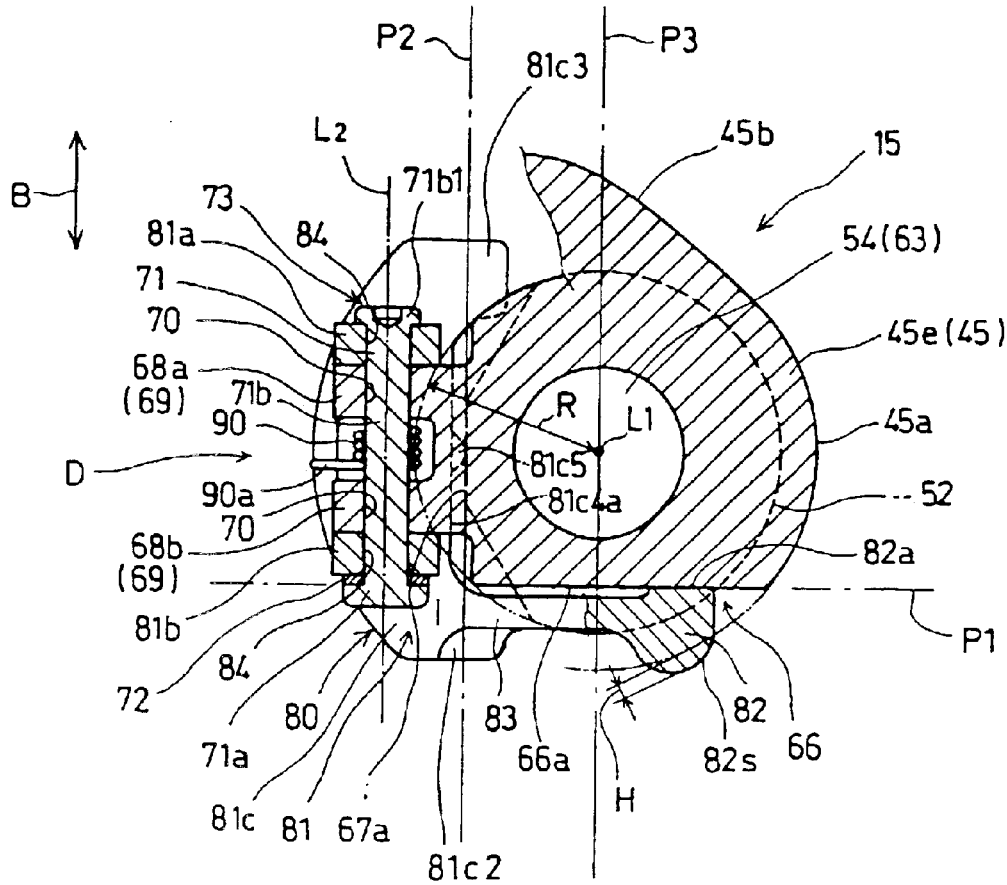
FIG. 4 is a sectional view taken on line IV—IV in FIG. 7A.
Figure 5:
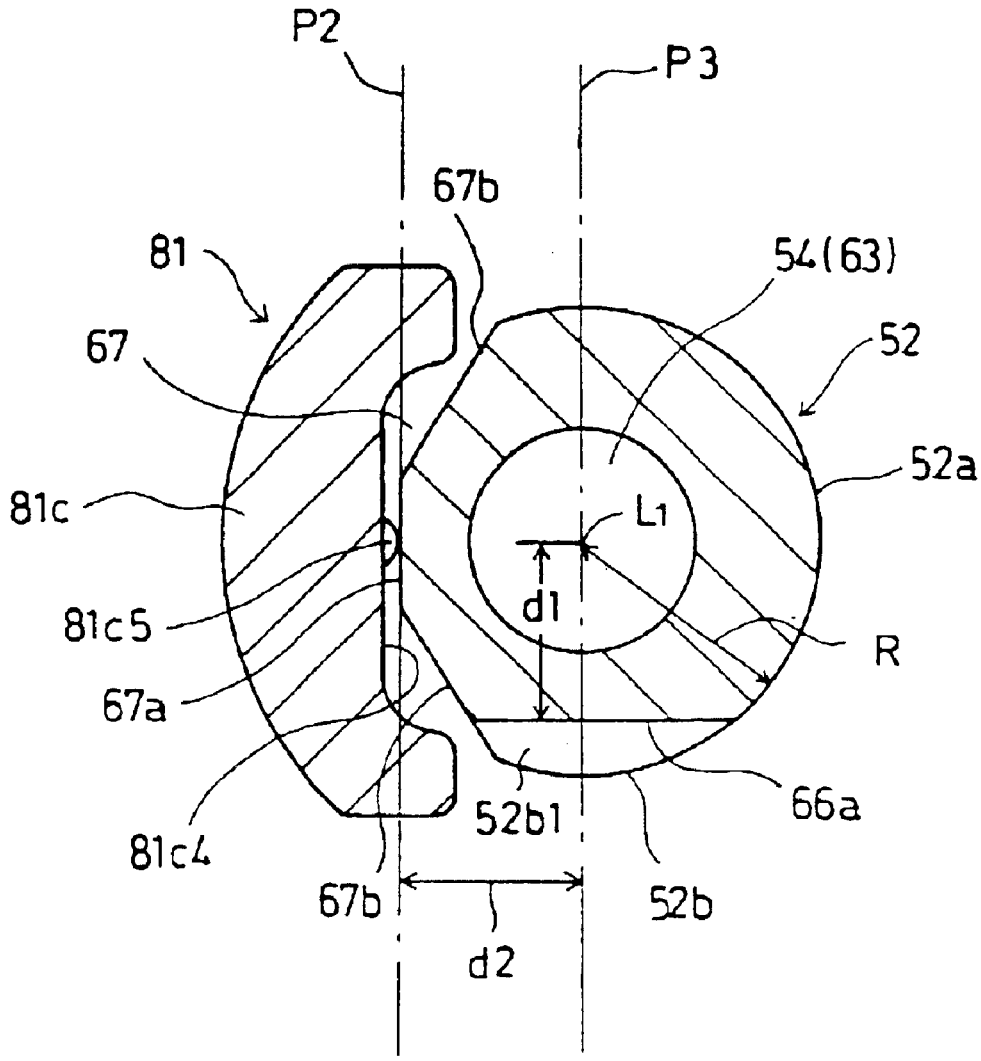
FIG. 5 is a sectional view taken on line V—V in FIG. 7A.
Figure 6A:
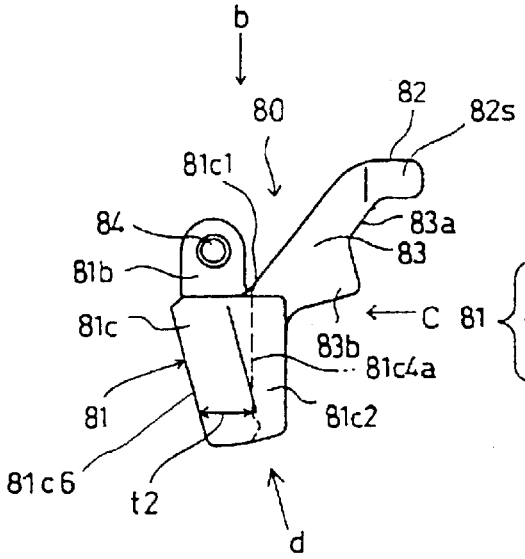
FIG. 6A is a side elevation of a decompression member included in the decompressing mechanism shown in FIG. 1.
Figure 6B:
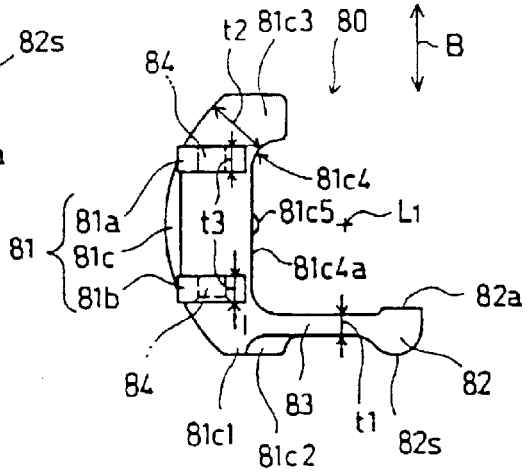
FIG. 6B is a view taken in the direction of the arrow b in FIG. 6A.
Figure 6C:
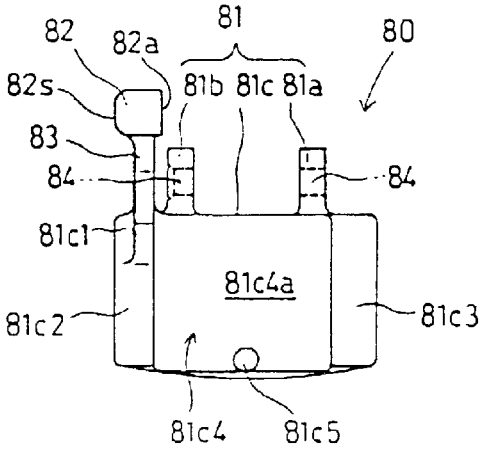
FIG. 6C is a view taken in the direction of the arrow c in FIG. 6A.
Figure 6D:
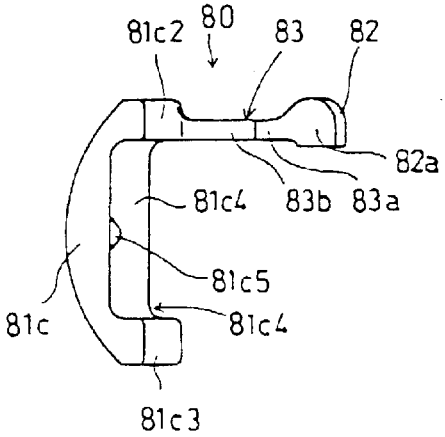
FIG. 6D is a view taken in the direction of the arrow d in FIG. 6A.
Figure 7A:
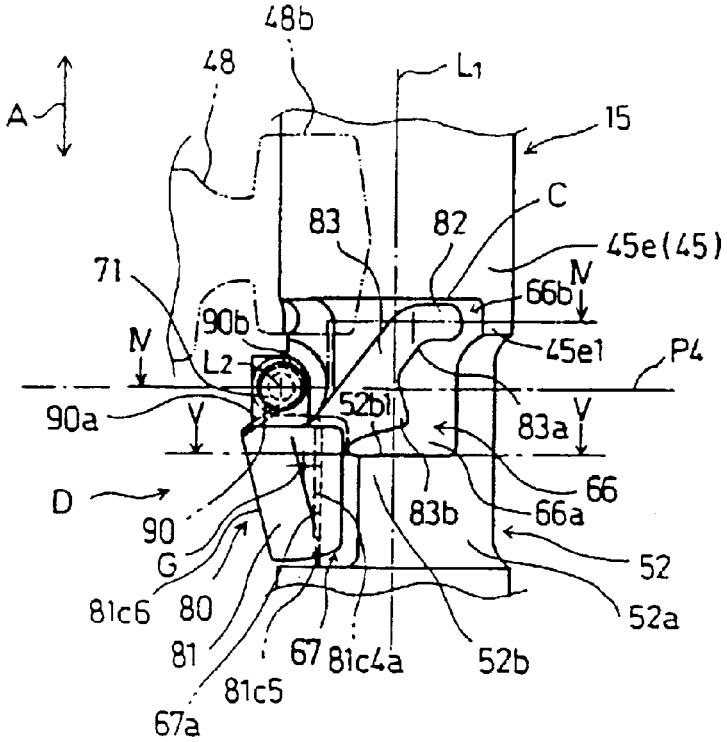
FIG. 7A is an enlarged view of an essential part in FIG. 2, showing the decompressing mechanism at an initial position.

Referring to FIGS. 4, 5 and 7A, each decompressing mechanism D is formed on the shaft part 52 contiguous with the exhaust cam part 45*e* in contact with the slipper 48*b* of the exhaust rocker arm 48 of the valve-operating cam 45. As shown in FIG. 7A, a cut part 66 is formed between a lower end part 45*e*1 contiguous with the shaft part 52 of the exhaust cam part 45*e*, and the shaft part 52 below the lower end part 45*e*1. The cut part 66 has a bottom surface 66*a* included in a plane P1 (FIG. 4) perpendicular to an axis L2 of swing motion. A cut part 67 is formed in the shaft part 52 so as to extend downward from a position overlapping the cut part 66 with respect to the direction of the arrow A parallel to the axis of rotation. The cut part 67 has a middle bottom surface 67*a* included in a plane P2 perpendicular to the plane P1 and parallel to the axis L1 of rotation, and a pair of end bottom surfaces 67*b* (FIG. 5) inclined to the middle bottom surface 67*a* and parallel to the axis L1 of rotation.

More concretely, the cut part 66 is formed by cutting a part of the lower end part 45*e*1 of the exhaust cam part 45*e* and a part near the exhaust cam part 45*e* of the shaft part 52 such that the distance d1 (FIG. 5) between the axis L1 of rotation of the bottom surface 66*a* is smaller than the radius R of the cylindrical surface 52*a*, and the bottom surface 66*a* is nearer to the axis L1 of rotation than the surface of the shaft part 52. The cut part 67 is formed by cutting part of the shaft part 52 such that the distance d2 (FIG. 5) between the middle bottom surface 67*a* and a reference plane P3 including the axis L1 of rotation and parallel to the axis L2 of swing motion is smaller than the radius R of the cylindrical surface 52*a*, and the bottom surface 67*a* is nearer to the axis L1 of rotation than the surface of the shaft part 52.

As shown in FIGS. 4 and 7A, a holding part 69 is formed above the cut part 67 in the shaft part 52. The holding part 69 has a pair of projections 68*a* and 68*b* radially outwardly projecting from the shaft part 52 in parallel to the plane P1. The projections 68*a* and 68*b* are provided with holes 70, and a cylindrical pin 71 is fitted in the holes 70 of the arms 68*a* and 68*b*, and a flyweight 81 is supported by the pin 71 for swing motion relative to the camshaft 15. The projections 68*a* and 68*b* are spaced a distance apart in the direction of the axis of the pin 71 and are formed integrally with the camshaft 15.

Referring to FIGS. 4 and 6A to 6C, each decompressing mechanism D includes a decompression member 80 of a metal, such as an iron alloy containing 15% nickel, and a return spring 90. The return spring 90 is a torsion coil spring. The decompression member 80 has the flyweight 81 supported for turning by the pin 71 on the holding part 69, a decompression cam 82 that swings together with the flyweight 81, comes into contact with the slipper 48*b* of the exhaust rocker arm 48 in a starting phase of the internal combustion engine E to exert a valve opening force on the exhaust valve 43, and a flat arm 83 connecting the flyweight 81 and the decompression cam 82. The decompression member 80 is a molding integrally including the flyweight 81, the decompression cam 82 and the arm 83, and is formed by metal injection. Metal injection is a forming method for manufacturing an article by sintering a shaped body of metal powder formed by injecting the metal powder.

The return spring 90 extended between the pair of projections 68*a* and 68*b* has one end 90*a* engaged with the flyweight 81, and the other end 90*b* (FIG. 7A) engaged with the projection 68*a*. The resilience of the return spring 90 is adjusted so that a torque capable of holding the flyweight 81 at an initial position or a decompressing position (FIG. 7A) is applied to the flyweight 81 while the engine speed is below a predetermined engine speed.

The flyweight 81 has a weight body 81*c*, and a pair of flat projections 81*a* and 81*b* projecting from the weight body

81*c* and lying on the outer side of the projections 68*a* and 68*b*, respectively, with respect to a direction parallel to a turning axis L2 of the flyweight 81 (hereinafter referred to as "axial direction B"). The projections 81*a* and 81*b* extend from the weight body 81*c* toward the pin 71. The projections 81*a* and 81*b* have a thickness t3, i.e., thickness along the axial directions B shown in FIG. 6, slightly greater than the thickness t1 of the arm 83 and smaller than the thickness t2 of the weight body Sic of the flyweight 81 in a diametrical direction shown in FIG. 6*b* by way of example. The projections 81*a* and 81*b* are provided with holes 84 of a diameter equal to that of the holes 70.

Referring mainly to FIG. 4, the pin 71 has a cylindrical part 71*b* and a head 71*a*. A spring washer 72, i.e., an elastic member, is put on a part, between the head 71*a* of the pin and the projection 81*b*, of the cylindrical part 71*b* of the pin 71. The pin extends in a direction B, which is the direction of the axis L2 of swing motion, through the holes 70 and the holes 84 so as to be turnable. In mounting the flyweight 81 on the camshaft 15, the spring washer 72, the holes 84 of the projections 81*a* and 81*b*, the holes 70 of the projections 68*a* and 68*b* and the return spring 90 are aligned, and the pin 71 is inserted in the spring washer 72, the hole 84 of the projection 91*b*, the hole 70 of the projection 68*b*, the return spring 90, the hole 70 of the projection 68*a* and the hole 84 of the projection 81*a* in that order. An end part 71*b*1, projecting from the projection 81*a*, of the cylindrical part 71*b* of the pin 71 is deformed by pressing to form a retaining part 73 that retains the pin 71 on the flyweight 81.

Thus, the decompression member 80 including the flyweight 81 can be easily mounted on the camshaft 15 so as to be turnable without using any pressing process. The spring washer 72 exerts a resilient force on the pin 71 and the projection 81*b* in the axial direction B to absorb the deviation of the degree of pressing for the plastic deformation of the end part 71*b*1 to form the retaining part 73. Thus, the gap between the pin 71 and the flyweight 81 with respect t the axial direction B is reduced to null and, consequently, the movement of the pin 71 and the flyweight 81 relative to each other with respect to the axial direction B is prevented or controlled.

Frictional forces due to the resilience of the spring washer 72 acting between the head 71*a* of the pin 71 and the spring washer 72, between the projection 81*b* and the spring washer 72 and between the retaining part 73 and the projection 81*a* prevent the movement of the pin 71 and the flyweight 81 relative to each other with respect to the turning direction.

Thus, the spring washer 72 serves as a restraint or restraining means for restraining the pin 71 and the flyweight 81 from movement relative to each other. Since the pin 71 and the flyweight 81 are thus frictionally connected by the resilience of the spring washer 72, the pin 71 turns in the holes 70 of the holding parts 69 together with the flyweight 81 when the flyweight 81 turns relative to the camshaft 15, and the pin 71 and the flyweight 81 are prevented or restrained from being moved relative to each other by the vibrations of the internal combustion engine E when the flyweight is at a full-expansion position or a decompression withholding position.

Figure 8A:
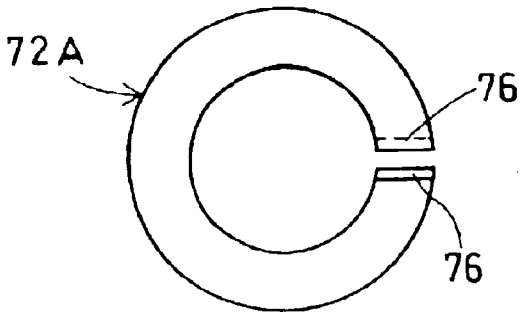
FIG. 8A is a front elevation of a spring washer.
Figure 8B:
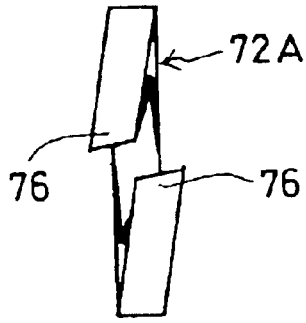
FIG. 8B is a side elevation of the spring washer shown in FIG. 8A.

The spring washer 72 may be an optional known spring washer. FIGS. 8A to 12B show possible spring washers. A spring washer 72A shown in FIGS. 8A and 8B is a spiral ring having a break between ends 76 which are axially separated from each other. The spiral spring washer 72A produces resilience when the same is axially elastically deformed so that the ends 76 coincide with each other.

Figure 9:
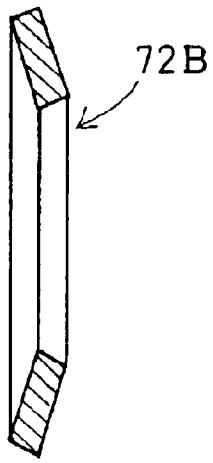
FIG. 9 is a side elevation of another spring washer.
Figure 10:
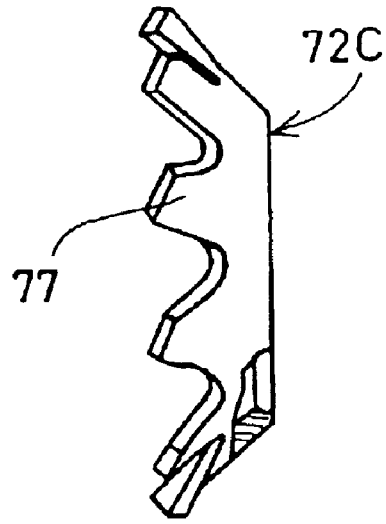
FIG. 10 is a side elevation of still another spring washer.

A spring washer 72B shown in FIG. 9 is a conical spring washer having the shape of a truncated cone. A spring washer 72C shown in FIG. 10 is a countersunk external tooth washer having the shape of a truncated cone and provided on the bottom circumference thereof with radial teeth 77 arranged at angular intervals. The elastic deformation of the teeth 77 contributes to the production of resilience.

Figure 11:
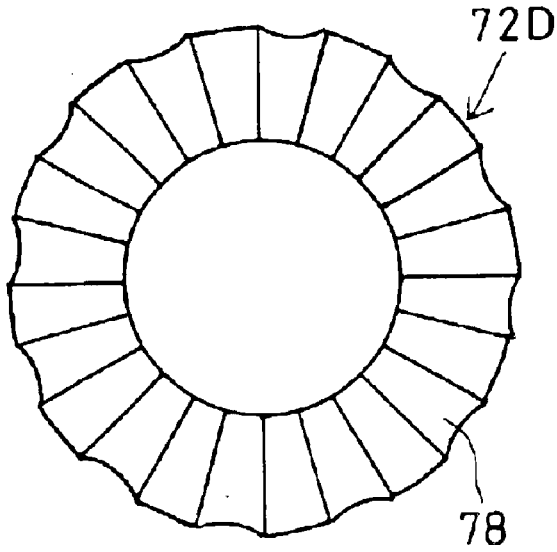
FIG. 11 is a front elevation of a further spring washer.

A spring washer 72D shown in FIG. 11 has a plurality of radial crimps 78 of a curved or triangular cross section. The spring washer 72D produces resilience when the spring washer 72D is axially compressed to deform the crimps 78 elastically.

Figure 12A:
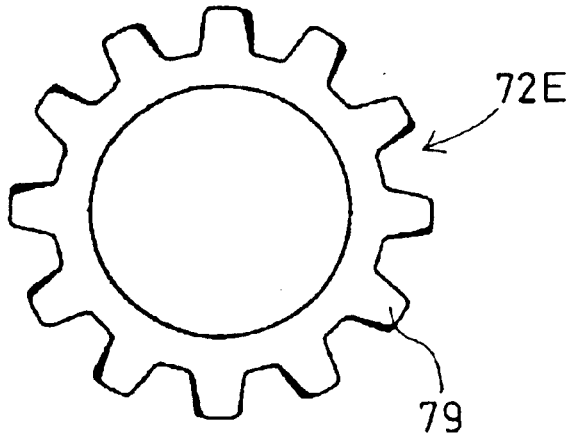
FIG. 12A is a front elevation of a still further spring washer.
Figure 12B:
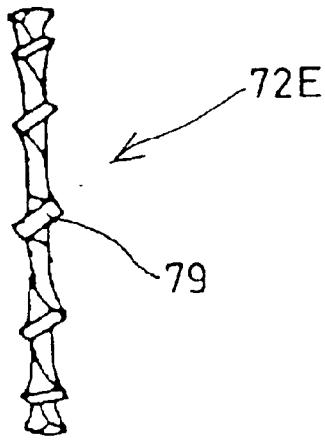
FIG. 12B is a side elevation of the spring washer shown in FIG. 12A.

A spring washer 72E shown in FIGS. 12A and 12B is provided on its outer circumference with a plurality of radial, twisted teeth 79. The spring washer 72E produces resilience when the spring washer 72E is axially compressed to deform the twisted, teeth elastically.

The axis L2 of swing motion aligned with the axis of the pin 71 is included in a plane P4 (FIGS. 7A and 7B) substantially perpendicular to the axis L1 of rotation of the camshaft 15 and does not intersect the axis L1 of rotation and the bore 54. In this embodiment, the axis L2 of swing motion is at a distance greater than the radius R of the shaft part 52 from the axis L1 of rotation or the reference plane P3 as shown in FIG. 4. Therefore, the holding part 69 having the projections 68*a* and 68*b* is able to set the axis L2 of swing motion at a distance greater than the radius R of the shaft part 52 from the reference plane P3. Consequently, the pin 71 does not intersect the axis L1 of rotation and the bore 54, and is separated diametrically from the axis L1 of rotation and the bore 54. In this specification, a condition expressed by "substantially perpendicular intersection" includes both perpendicular intersection and nearly perpendicular intersection.

As best shown in FIGS. 4 and 6A to 6D, the weight body 81*c* of the flyweight 81 has a thickness t2 along a diametrical direction greater than the thickness t1 of the arm 83. The weight body 81*c* extends from the joint 81*c*1 of the flyweight 81 and the arm 83 on the side of the axis L1 of rotation with respect to the arm 83 along the axis L2 of swing motion to a position on the opposite side of the arm 83 with respect to the axis L1 of rotation, and has opposite end parts 81*c*2 and 81*c*3 with respect to the axis L2 of swing motion extending nearer to the reference plane P3 than the middle bottom surface 67*a* of the cut part 67. When the decompression member 80 is at the initial position, the outer surface 81*c*6 of the weight body 81*c* extends radially inward with distance from the pin 71 toward the direction of the arrow A. In this embodiment, the outer surface 81*c*6 extends so as to approach radially the shaft part 52 with downward distance. The arm 83 projecting from the weight body 81*c* in a direction different from a direction in which the projections 81*a* and 81*b* extend is received in the cut part 66 when the decompression member 80 is at the initial position and extends along the bottom surface 66*a* on the side of one end part 81*c*2 of the body 81*c*.

Figure 7B:
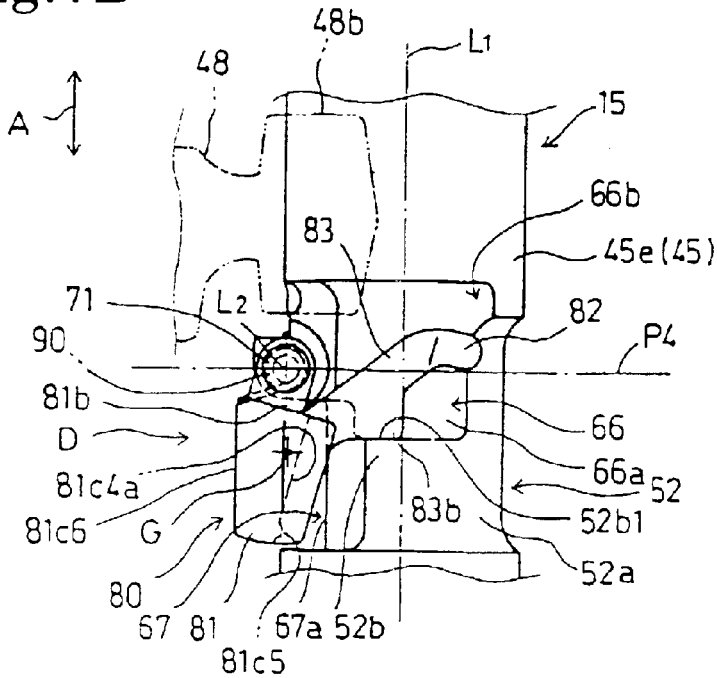
FIG. 7B is a view of the decompressing mechanism at a full-expansion position.

Referring to FIGS. 7A and 7B, a contact protrusion 81*c*5 is formed in a flat part 81*c*4*a* of the inner surface 81*c*4 facing the camshaft 15 of the weight body 81*c*. The contact protrusion 81*c*5 rests on the middle bottom surface 67*a* of the cut part 67 when the flyweight 81 (or the decompression member 80) is set at the initial position. When the decompression member 80 is at the initial position, a gap C (FIG. 7A) is formed between the decompression cam 82 and the valve-operating cam 45 with respect to the direction indicated by the arrow A. A contact protrusion 83*b* (FIG. 6A) is formed on the flat lower end surface of the arm 83. The contact protrusion 83*b* rests on the upper surface 52*b*1 of a step 52*b* (FIG. 7A) adjacent to the bottom surface 66*a* and forming the lower side wall of the cut part 66 to determine a full-expansion position for the radially outward swing motion of the flyweight 81 (or the decompression member 80).

In an initial state where the decompression cam 82 is separated from the slipper 48*b* and the camshaft 15 is stopped, the contact protrusion 81*c*5 is in contact with the middle bottom surface 67*a* (FIG. 5) and the flyweight 81 (or the decompression member 80) stays at the initial position with a part thereof lying in the cut part 67 until the internal combustion engine E is started, the camshaft 15 is rotated, and a torque acting about the axis L2 of swing motion and produced by centrifugal force acting on the decompression member 80 increases beyond an opposite torque produced by the resilience of the return spring 90. When the slipper 48*b* is in contact with the decompression cam 82, the flyweight 81 is restrained from swinging by frictional force acting between the decompression cam 82 and the slipper 48*b* pressed by the resilience of the valve spring 44 against the decompression cam 82 even if the torque produced by the centrifugal force exceeds the opposite torque produced by the resilience of the return spring 90.

When the decompression member 80 is at the initial position, the distance between a flat part 81*c*4*a* (FIG. 6B) farthest from the reference plane P3 of the inner surface 81*c*4 and the reference plane P3 is shorter than the radius R of the cylindrical surface 52*a* as shown in FIG. 4. The center G of gravity (FIG. 7A) of the decompression member 80 is always on the side of the reference plane P3 with respect to a vertical line crossing the axis L2 of swing motion when the decompression member 80 swings in a maximum range of swing motion between the initial position and the full-expansion position, and is slightly on the side of the reference plane P3 with respect to the vertical line crossing the axis L2 of swing motion when the decompression member 80 is at the initial position. Thus, the flyweight 81 approaches the reference plane P3 or the axis L1 of rotation when the flyweight 81 is turned to the full-expansion position.

The decompression cam 82 formed at the extremity of the arm 83 has a cam lobe 82*s* (FIG. 4) protruding in the direction of the axis L2 of swing motion, and a contact surface 82*a* on the opposite side of the cam lobe 82*s*. The contact surface 82*a* is in contact with the bottom surface 66*a* and slides along the bottom surface 66*a* when the arm 83 swings together with the flyweight 81. When the decompression member 80 is at the initial position, i.e., when the decompression member 80 is in the decompressing operation, the decompression cam 82 is on the opposite side of the axis U of swing motion and the flyweight 81 with respect to the reference plane P3, is received in an upper part 66*b* (FIG. 7A), contiguous with the exhaust cam part, of the cut part 66, and projects radially by a predetermined maximum height H (FIGS. 3 and 4) from the heel 45*a* included in the base circle of the valve-operating cam 45. The predetermined height H defines a decompression lift $L_D$ (FIG. 3) by which the exhaust valve 43 is lifted up for decompression.

While the decompression cam 82 is in contact with the slipper 48*b* of the exhaust rocker arm 48 to open the exhaust valve 43, load placed by the resilience of the valve spring 44 on through the exhaust rocker arm 48 on the decompression cam 82 is born by the bottom surface 66*a*. Consequently, load that is exerted on the arm 83 by the exhaust rocker arm 48 during the decompressing operation is reduced and hence the thickness t1 of the arm 83 may be small.

The operation and effect of the embodiment will be described.

While the internal combustion engine E is stopped and the camshaft 15 is not rotating, the center G of gravity of the decompression member 80 is on the side of the reference plane P3 with respect to the axis L2 of swing motion, and the decompression member 80 is in an initial state where a clockwise torque, as viewed in FIG. 7A, produced by the weight of the decompression member 80 about the axis L2 of swing motion and a counterclockwise torque produced by the resilience of the return spring 90 act on the decompression member 80. Since the resilience of the return spring 90 is determined such that the counterclockwise torque is greater than the clockwise torque produced by the weight of the decompression member 80, the flyweight 81 (or the decompression member 80) is held at the initial position as shown in FIG. 7A, and the decompression cam 82 is received in the upper part 66*b* contiguous with the exhaust cam part of the cut part 66.

The crankshaft 8 is rotated by pulling a starter knob 13*a* (FIG. 1) connected to a rope wound on a reel included in the rewind starter 13 to start the internal combustion engine E. Then, the camshaft 15 rotates at a rotating speed equal to half the rotating speed of the crankshaft 8. The rotating speed of the crankshaft 8, i.e., the engine speed, is not higher than the predetermined engine speed in this state, and hence the decompression member 80 is held at the initial position because the torque produced by centrifugal force acting on the decompression member 80 is lower than the torque produced by the resilience of the return spring 90. When each cylinder bore 2*a* is in a compression stroke, the decompression cam 82 radially projecting from the heel 45*a* of the valve-operating cam 45 comes into contact with the slipper 48*b* to turn the exhaust rocker arm 48 such that the exhaust valve 43 is lifted up by the predetermined decompression lift $L_D$. Consequently, the air-fuel mixture compressed in the cylinder bore 2*a* is discharged through the exhaust port 41, so that the pressure in the cylinder bore 2*a* decreases, the piston 6 is made easily to pass the top dead center, and hence the rewind starter 13 can be operated by a low force.

After the engine speed has exceeded the predetermined engine speed, the torque produced by the centrifugal force acting on the decompression member 80 exceeds the torque produced by the resilience of the return spring 90. If the decompression cam 82 is separated from the slipper 48*b* of the exhaust rocker arm 48, the decompression member 80 starts being turned clockwise, as viewed in FIG. 7A, by the torque produced by the centrifugal force, the arm 83 slides along the bottom surface 66*a*, the decompression member 80 is turned until the same reaches the full-expansion position where the contact protrusion 83*b* of the arm 83 is in contact with the upper surface 52*b*1 of the step 52*b* as shown in FIG. 7B. With the decompression member 80 at the full-expansion position, the decompression cam 82 is separated from the upper part 66*b* contiguous with the exhaust cam part of the cut part 66 in the direction of the arrow A and is separated from the slipper 48*b*, so that the decompressing operation is stopped. Consequently, the slipper 48*b* is in contact with the heel 45*a* of the exhaust cam part 45*e* while the cylinder bore 2*a* is in a compression stroke as indicated by two-dot chain lines in FIG. 3 to compress an air-fuel mixture at a normal compression pressure. Thereafter, the engine speed increases to an idling speed. With the decompression member 80 at the full-expanded position, the center G of gravity of the decompression member 80 is at a distance approximately equal to the distance d2 (FIG. 5) between the axis 12 of swing motion and the reference plane P3 from the reference plane P3. Since the outer surface 81*c*6 of the weight body 81*c* of the flyweight 81 extends radially inward with distance from the pin 71 downward, the radial expansion of a cylindrical space in which the flyweight 81 revolves is suppressed, and the circumference of the cylindrical space coincides substantially with the cylindrical surface 52*a* having the shape of a circular cylinder of the shaft art 52.

Facility of mounting the flyweight 81 on the camshaft 15 is improved because the pin 71 supporting the flyweight 81 of the decompression member 80 having the decompression cam 82 that applies a valve opening force to the exhaust valve 43 is supported so as to be turnable on the camshaft 15. Since the spring washer 72 is placed between the pin 71 inserted so as to be turnable in the holes 84 of the flyweight 81 and the flyweight 81 to restrain the pin 71 and the flyweight 81 from movement relative to each other in the axial direction B and in the turning direction, frictional forces due to the resilience of the spring washer 72 acting between the pin 71 and the spring washer 72, between the spring washer 72 and the flyweight 81 and between the pin 71 and the flyweight 81 prevent the pin 71 and the flyweight 81 being moved relative to each other by the vibrations of the internal combustion engine E when the flyweight 81 is at the decompression withholding position. Thus, the generation of rattling noise due to the collision between the pin 71 and the flyweight 81 can be prevented or controlled by the simple method using the spring washer 72.

The spring washer 72 exerts resilient force on the pin 71 and the flyweight 81 in the axial direction B to absorb the deviation of the degree of plastic deformation of the pin 71 to form the retaining part 73 so that any gap in the axial direction B may not be formed between the pin 71 and the flyweight 81 due to the deviation of the degree of plastic deformation. Consequently, the pin 71 and the flyweight 81 can be accurately restrained from movement in the axial direction B relative to each other.

Figure 13:
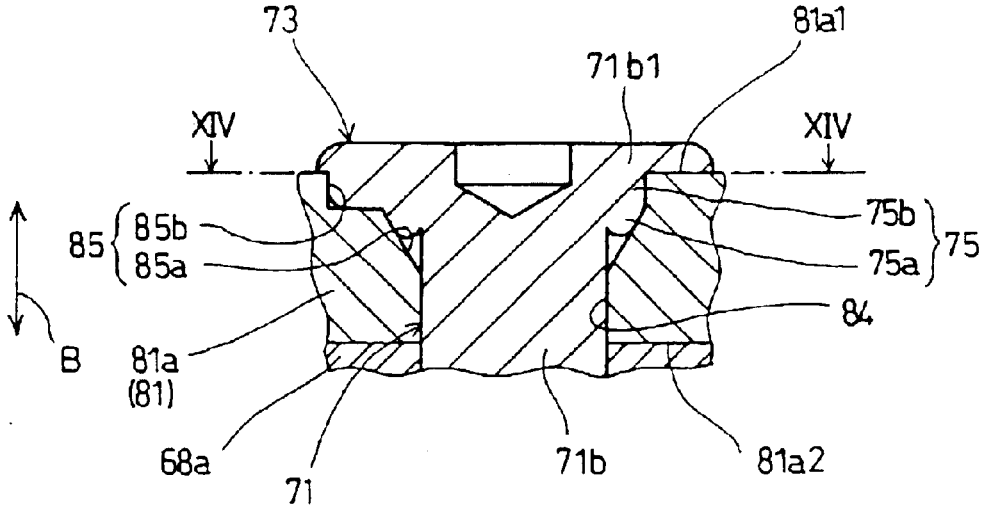
FIG. 13 is an enlarged sectional view of a part, corresponding to the part shown in FIG. 4, of an internal combustion engine in a second embodiment of the present invention taken on line XIII—XIII in FIG. 14.
Figure 14:
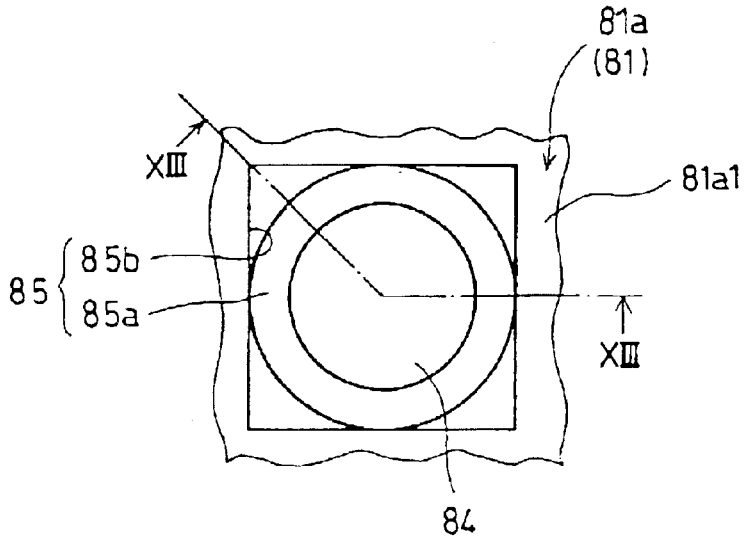
FIG. 14 is a view taken in the direction of the arrows along the line XIV—XIV in FIG. 13.

A second embodiment of the present invention will be described with reference to FIGS. 13 and 14. The second embodiment is basically identical with the first embodiment and differs from the first embodiment only in using, as a restraining means for restraining a pin 71 and a flyweight 81 from movement relative to each other, a pair of connecting parts instead of the spring washer 72. In FIGS. 13 and 14, parts like or corresponding to those of the first embodiment are denoted by the same reference characters.

Referring to FIGS. 13 and 14, a projection 81*a* of the flyweight 81 has connecting part 85 having a hollow having a detaining part 85*b* and a taper part 85*a* converging in the direction B and merging into a hole 84 arranged in that order from one end surface 81*a*1 of the projection 81*a* in contact with a retaining part 73 toward the other end surface 81*a*2 of the projection 81*a*. The taper part 85*a* of the connecting part 85 has a taper surface, i.e., a conical surface, coaxial with the axis L2 of swing motion. The detaining part 85*b* has a noncircular cross section in a plane perpendicular to the axis L2 of swing motion. In this embodiment, the detaining part 85*b* has a square cross section.

On end part 71*b*1 of the pin 71 has a retaining part 73 formed by plastic deformation after inserting the pin 71 in the hole 84, and a connecting part 75 formed by pressing the end part 71*b*1 in the hollow. The connecting part 75 has a taper part 75*a* and a detaining part 75*b* respectively conforming to the taper part 85*a* and the detaining part 85*b*, and formed through plastic deformation using the taper part 85*a* and the detaining part 85*b* as forming dies.

A gap in the axial direction B is formed scarcely between the pin 71 and the flyweight 81 in the connecting parts 75 and 85 when the taper part 75*a* and the detaining part 75*b* are engaged with the taper part 85*a* and the detaining part 85*b*, respectively. Since the taper part 75*a* is formed through the plastic deformation of the end part 71*b*1 so as to conform to the taper part 85*b*, deviation of the degree of plastic deformation can be easily absorbed by the taper parts 75*a* and 85*a*.

In the second embodiment, the pin 71 and the flyweight 81 are restrained from movement in the axial direction B and the turning direction relative to each other by the engagement of the connecting parts 75 and 85. The second embodiment has the following operation and effects in addition to the operation and effects in restraining the pin 71 and the flyweight 81 from movement in the axial direction B and the turning direction relative to each other, excluding the operation and effects characteristic of the spring washer 72 as a restraining means.

The connecting part 85 has the taper part 85*a* and the detaining part 85*b*, and the connecting part 75 has the taper part 75*a* and the detaining part 75*b* formed by plastically deforming the end part of the pin 71 so as to conform to the taper part 85*a* and the detaining part of the connecting part 85 alter inserting the pin 71 in the holes 84. Therefore, the deviation of the degree of plastic deformation can be easily absorbed by the respective taper parts 75*a* and 85*a* of the connecting parts 75 and 85, a gap in the axial direction B is formed scarcely between the pin 71 and the flyweight 81 in the taper parts 75*a* and 85*a*, and a gap in the turning direction is scarcely formed between the pin 71 and the flyweight 81 in the detaining parts 75*b* and 85*b*. Thus, gaps in the axial direction B and the turning direction are formed scarcely between the pin 71 and the flyweight 81 in the connecting parts 75 and 85, and the pin 71 and the flyweight 81 are restrained accurately from movement relative to each other.

Decompressing mechanisms in modifications of the foregoing decompressing mechanisms will be described.

Figure 15:
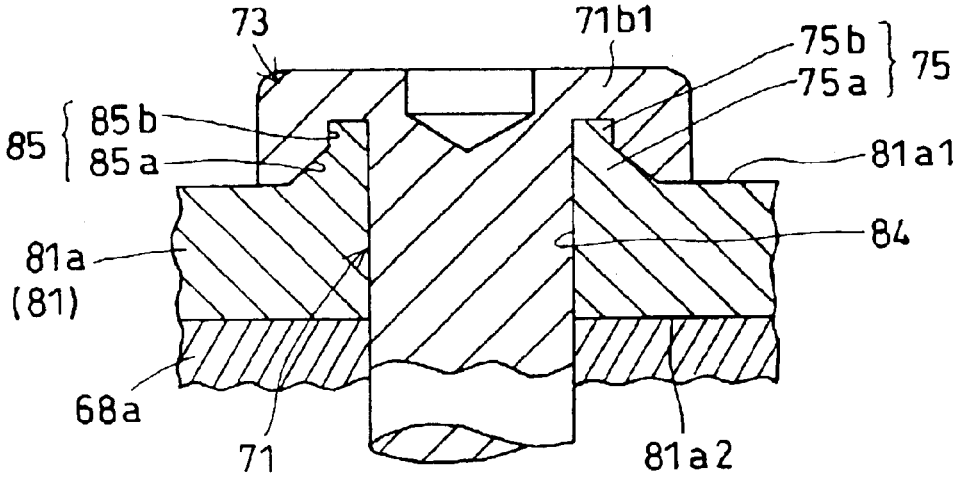
FIG. 15 is a sectional view of a modification of the part shown in FIG. 13.

FIG. 15 shows a modification of the second embodiment shown in FIGS. 13 and 14. In the modification shown in FIG. 15, a convex connecting part 75 and a concave connecting part 85 correspond to the concave connecting part 85 and the convex connecting part 75 of the second embodiment, respectively. A projection 81*a* of a flyweight 81 has the convex connecting part 75 on its end surface 81*a*1, and a pin 71 is provided at its end part 71*b*1 with the concave connecting part 85 provided with a hollow. The hollow of the connecting part 85 of the pin 71 is shaped in a shape conforming to that of the convex connecting part 85 by plastic deformation using the convex connecting part 85 of the projection 81*a* as a forming die. The connecting part 75 has a taper part 75*a* and a detaining part 75*b*, and the connecting part 85 has a taper part 85*a* and a detaining part 85*b*.

The restraint or restraining means of the first embodiment is the spring washer 72 and the restraint or restraining means of the second embodiment is the combination of the connecting parts 75 and 85. The restraint or restraining means may include both the spring washer 72 and the combination of the connecting parts 75 and 85.

Although the intake valve 42 and the exhaust valve 43 are operated for opening and closing by the single, common valve-operating cam 45 in the foregoing embodiment, the intake valve 42 and the exhaust valve 43 may be controlled by a valve-operating cam specially for operating the intake valve 42 and a valve-operating cam specially for operating the exhaust valve 43, respectively. The intake valve 42 may be operated by the decompressing mechanism instead of the exhaust valve 43.

Although the center G of gravity of the decompression member 80 is nearer to the reference plane P3 than the axis L2 of swing motion and the decompression member 80 is held at the initial position by the return spring 90 in the foregoing embodiment, the center G of gravity of the decompression member 80 may be farther from reference plane P3 than the axis L2 of swing motion, the decompression member 80 may be held at the initial position by a torque produced by its own weight, and the return spring 90 may be omitted.

The present invention is applicable to an internal combustion engine provided with a crankshaft supported with its axis horizontally extended, to general-purpose engines other than the outboard motor, such as engines for driving generators, compressors, pumps and such, and automotive engines. The internal combustion engine may be a single-cylinder internal combustion engine or a multiple-cylinder engine having three or more cylinders.

Although the internal combustion engine in the foregoing embodiments is a spark-ignition engine, the internal combustion engine may be a compression-ignition engine. The starting device may be any suitable starting device other than the rewind starter, such as a kick starter, a manual starter or a starter motor.

What is claimed is:

1. An internal combustion engine comprising: a crankshaft; a camshaft driven for rotation in synchronism with the crankshaft; an engine valve controlled for opening and closing by a valve-operating cam; and a decompressing mechanism for opening the engine valve during a compression stroke in a starting phase;

wherein the decompressing mechanism includes: a pin supported so as to be turnable on the camshaft; a flyweight supported for turning relative to the camshaft by the pin on the camshaft; and a decompression cam operating together with the flyweight to apply valve opening force to the engine valve; the pin is inserted in holes formed in the flyweight so as to be turnable; and a restraint is provided to restrain the pin and the flyweight from movement relative to each other, wherein the restraint restrains the pin and the flyweight from movement relative to each other in directions parallel to an axis of turning of the flyweight, and wherein the restraint is an elastic member placed between the pin and the flyweight and applying resilient force to the pin and the flyweight.

2. The internal combustion engine according to claim 1, wherein the elastic member is a spring washer put on the pin.

3. An internal combustion engine comprising: a crankshaft; a camshaft driven for rotation in synchronism with the crankshaft; an engine valve controlled for opening and closing by a valve-operating cam; and a decompressing mechanism for opening the engine valve during a compression stroke in a starting phase;

wherein the decompressing mechanism includes: a pin supported so as to be turnable on the camshaft; a flyweight supported for turning relative to the camshaft by the pin on the camshaft; and a decompression cam operating together with the flyweight to apply valve opening force to the engine valve; the pin is inserted in holes formed in the flyweight so as to be turnable; and a restraint is provided to restrain the pin and the flyweight from movement relative to each other, wherein the restraint restrains the pin and the flyweight from movement relative to each other in turning directions of turning of the flyweight, and wherein the restraint includes: a first connecting part formed in one of the pin and the flyweight; and a second connecting part formed in one of the flyweight and the pin for engaging with the first connecting part; and the first and the second connecting part have a first detaining part and a second detaining part, respectively.

4. The internal combustion engine according to claim 3, wherein the first and the second detaining parts have non-circular shapes, respectively, as viewed along the axis of turning of the flyweight.

5. The internal combustion engine according to claim 3, wherein the first connecting part has a first taper part and a first detaining part, and the second connecting part has a second taper part and a second detaining part formed through plastic deformation of a part of one of the flyweight and the pin so that the second taper part and the second detaining part conform to the first taper pert and the first detaining part after inserting the pin in the holes.

6. An internal combustion engine comprising: a crankshaft; a camshaft driven for rotation in synchronism with the crankshaft; an engine valve controlled for opening and closing by a valve-operating cam; and a decompressing mechanism for opening the engine valve during a compression stroke in a starting phase;

wherein the decompressing mechanism includes: a pin supported so as to be turnable on the camshaft; a flyweight supported for turning relative to the camshaft by the pin on the camshaft; and a decompression cam operating together with the flyweight to apply valve opening force to the engine valve; the pin is inserted in holes formed in the flyweight so as to be turnable; and two restraints are provided to restrain the pin and the flyweight from movement relative to each other, one which restrains the pin end the flyweight from movement relative to each other in directions parallel to the turning axis of the flyweight, and another which restrains the pin end the flyweight from movement relative to each other in the turning directions of the flyweight.

* * * * *

UNITED STATES PATENT AND TRADEMARK OFFICE

CERTIFICATE OF CORRECTION

PATENT NO. : 6,817,331 B2
DATED : November 16, 2004
INVENTOR(S) : Takada et al.

It is certified that error appears in the above-identified patent and that said Letters Patent is hereby corrected as shown below:

Title page,
Item [56], References Cited, FOREIGN PATENT DOCUMENTS, change "2004-221023" to -- 2001-221023 --.

Column 9,
Line 9, change "weight body Sic" to -- weight body 81c --;

Column 11,
Line 54, change "of the axis U of" to -- of the axis L2 of --.

Column 13,
Line 4, change "between the axis 12" to -- between the axis L2 --.

Column 14,
Line 29, change "85 alter inserting" to -- 85 after inserting --.

Signed and Sealed this

Thirty-first Day of May, 2005

JON W. DUDAS
*Director of the United States Patent and Trademark Office*